US012590699B2

(12) United States Patent
Nix

(10) Patent No.: US 12,590,699 B2
(45) Date of Patent: Mar. 31, 2026

(54) COMBINATION EXHAUST STACK AND FLARE SYSTEMS AND METHODS

(71) Applicant: INNIO Waukesha Gas Engines Inc., Waukesha, WI (US)

(72) Inventor: Lorne Eugene Nix, Waukesha, WI (US)

(73) Assignee: Innio Waukesha Gas Engines Inc., Waukesha, WI (US)

( * ) Notice: Subject to any disclaimer, the term of this patent is extended or adjusted under 35 U.S.C. 154(b) by 482 days.

(21) Appl. No.: 18/162,553

(22) Filed: Jan. 31, 2023

(65) Prior Publication Data

US 2024/0255143 A1 Aug. 1, 2024

(51) Int. Cl.
*F23G 7/08* (2006.01)

(52) U.S. Cl.
CPC ..... *F23G 7/085* (2013.01); *F23G 2200/00* (2013.01); *F23G 2206/203* (2013.01); *F23G 2209/14* (2013.01)

(58) Field of Classification Search
CPC ..... F23G 7/085; F23G 2200/00; F23G 2206/203; F23G 2209/14
USPC ..... 431/5
See application file for complete search history.

(56) References Cited

U.S. PATENT DOCUMENTS 3,973,899 A * 8/1976 Reed ..... F23L 7/005 431/5
5,759,022 A * 6/1998 Koppang ..... C03B 5/235 431/5
2003/0143501 A1* 7/2003 Ferrigan ..... F23J 15/003 431/11
2008/0134658 A1* 6/2008 Yoshida ..... F02C 3/28 60/39.12
2011/0308482 A1* 12/2011 Hottovy ..... F02C 9/40 123/3
2012/0015308 A1* 1/2012 Hong ..... F23G 7/085 431/5
2013/0112543 A1* 5/2013 Mizokoshi ..... F01K 23/067 202/151
2014/0223820 A1* 8/2014 Yoshida ..... C10J 3/726 48/77
2022/0412252 A1* 12/2022 Bromberg ..... C10J 3/726

* cited by examiner

*Primary Examiner* — Avinash A Savani
(74) *Attorney, Agent, or Firm* — Fletcher Yoder, P.C.

(57) ABSTRACT

In certain embodiments, a hydrocarbon processing site may include an internal combustion engine that, during operation, generates an exhaust gas and one or more hydrocarbon processing components that receive a process fluid, output a first portion of the process fluid via a first outlet, and output a second portion of the process fluid via a second outlet. The hydrocarbon processing site may also include a combi-flare that includes an exhaust stack of the internal combustion engine and a flare section. The exhaust stack receives the second portion of the process fluid and the exhaust gas, and the second portion of the process fluid and the exhaust gas operationally mix within the exhaust stack. Additionally, the flare section generates a flame to burn the mixture of the second portion of the process fluid and the exhaust gas.

22 Claims, 5 Drawing Sheets

COMBINATION EXHAUST STACK AND FLARE SYSTEMS AND METHODS

BACKGROUND

The subject matter disclosed herein relates to engine exhaust systems and speciated organic gas (OG) flares. More specifically, the techniques discussed herein relate to a combi-flare that provides a combined engine exhaust stack and flare for improved efficiency.

In general, a hydrocarbon processing station may include a flare to burn excess or otherwise undesirable OGs and/or other compounds to avoid or reduce their release to the environment. Furthermore, due to the generated heat and flames, flares are typically located at an elevated and/or remote location using extensive piping to transfer the OGs and/or other compounds to the flare. Additionally, the hydrocarbon processing station may include one or more engines, which may include pistons disposed in respective cylinders of an engine block or a turbine section, to convert the expanding gases of a combustion process into mechanical energy. For example, engines may be used to drive a gas compression system that receives a gaseous fluid from an upstream source, increase the pressure of the gaseous fluid, and supply the gaseous fluid at the increased pressure to one or more downstream systems. In some scenarios, engine exhaust may also include OGs and/or other undesirable compounds. However, the individual and separate treatment of OGs sent to flares and exhaust from engines may lead to inefficiencies in the disposal of the OGs and/or hydrocarbon processing station development.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In certain embodiments, a hydrocarbon processing site may include an internal combustion engine that, during operation, generates an exhaust gas and one or more hydrocarbon processing components that receive a process fluid, output a first portion of the process fluid via a first outlet, and output a second portion of the process fluid via a second outlet. The hydrocarbon processing site may also include a combi-flare that includes an exhaust stack of the internal combustion engine and a flare section. The exhaust stack receives the second portion of the process fluid and the exhaust gas, and the second portion of the process fluid and the exhaust gas operationally mix within the exhaust stack. Additionally, the flare section generates a flame to burn the mixture of the second portion of the process fluid and the exhaust gas.

In certain embodiments, a method may include generating, via an internal combustion engine, an exhaust gas and receiving, via a first inlet of an exhaust stack of the internal combustion engine, the exhaust gas. The method may also include receiving, via a second inlet of the exhaust stack, speciated organic gases (OGs) desired to be disposed of via combustion, mixing, within the exhaust stack, the exhaust gas and the OGs, and burning, at a flare section disposed on the exhaust stack, the exhaust gas and the OGs.

In certain embodiments, a combi-flare includes an exhaust stack having a first inlet that receives an exhaust gas of a combustion process and a second inlet that receives speciated organic gases (OGs). The combi-flare may also include a flare section, disposed on top of the exhaust stack, having a pilot burner that ignites a mixture of the exhaust gas and the OGs.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
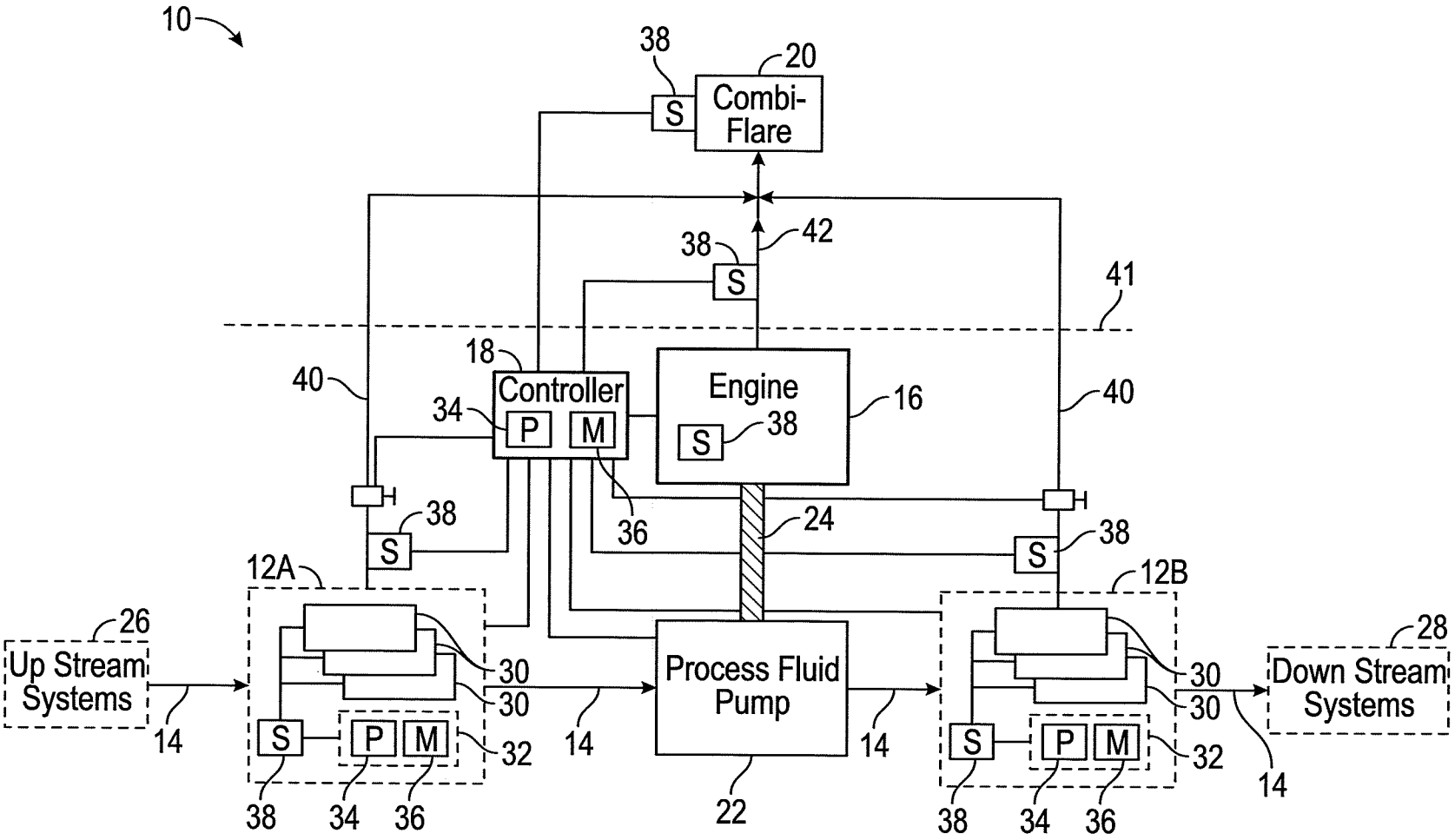
FIG. 1 is a schematic block diagram a hydrocarbon processing site including hydrocarbon processing systems to treat a process fluid, one or more engines, one or more controllers, and a combi-flare, in accordance with an embodiment.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As discussed in detail below, the techniques discussed herein relate to a combi-flare that provides a combined engine exhaust stack and a flare section for improved flaring efficiency. For example, the combi-flare may include at least a portion of an exhaust system (e.g., exhaust stack) and at least a portion of a flare system (e.g., the combustion section of a flare). In general, hydrocarbon processing sites utilize flares to dispose of undesired speciated organic gases (OGs) via controlled combustion. The OGs may include any suitable hydrocarbons or organic compounds that are preferably burned rather than being released into the atmosphere on their own. For example, the OGs sent to a flare may include continuous, batched, or variable flow streams of natural gas and/or other compounds such as but not limited to Methane ($CH_4$), Ethane ($C_2H_6$), Propane ($C_3H_8$), Butane ($C_4H_{10}$), Pentane ($C_5H_{12}$), Hexane ($C_6H_{14}$), Heptane ($C_7H_{16}$), "super heavies" (e.g., hydrocarbons ($C_{8+}$)), $H_2$, $H_2S$, $NH_3$, CO, $C_2H_2$, $C_2H_4$, $C_3H_6$, etc. Moreover, the OGs may also be mixed with additional compounds also sent to the flare such as nitrogen ($N_2$), carbon dioxide ($CO_2$), helium (He), argon (Ar), halogens (e.g., Cl, Fl), etc. Furthermore, as should be appreciated, while discussed herein as OGs, the fluids sent to the flare to be burned may include any of the categorical fugitive gases, total hydrocarbons (THC), volatile organic compounds (OG), non-methane hydrocarbons (NMHC), non-ethane hydrocarbons (NEHC), total organic gases (TOG), non-methane organic gases (NMOG), and/or hazardous air pollutants (HAPs) that are desired to be combusted via flaring. Moreover, as used herein, the term OGs may include any such compounds from one or more hydrocarbon processing systems sent to the combi-flare for combustion/release. Furthermore, as used herein, the burning or otherwise disposal of OGs via combustion refers to the oxidation reduction of such speciated organic compounds, which produces byproducts that may have more favorable properties than the OGs. In some scenarios, flares may be used as part of emergency relief systems and/or during startup/shutdown of operations of the hydrocarbon processing site to dispose of large volumes of OGs that would otherwise overpressure or flood the systems of the hydrocarbon processing site. As should be appreciated, while OGs are discussed herein, additional compounds may also be desired to be burned via flaring, and the term OGs should not be held as limiting unless explicitly stated.

Flares may be categorized by their height (e.g., ground or elevated) and/or by the method of enhancing mixing/combustion at the flare section (e.g., flare tip), which may include steam-assisted, air-assisted, pressure-assisted, and non-assisted flares, to name a few. For example, an elevated steam-assisted flare is elevated above the ground and injects steam into the combustion zone to promote turbulence for mixing. Additionally or alternatively, an air line may introduce air into the flame, promoting combustion, such as in an air-assisted flare. Moreover, flares may include enclosures to insulate (e.g., for heat, flame, noise, luminosity, wind, etc.) the flame from the environment and vice versa.

In addition to flares, hydrocarbon processing sites may also utilize combustion engines, such as piston engines and/or turbine engines, for mechanical power. For example, the engine(s) may be used to drive gas compressors to motivate the flow of hydrocarbons through the hydrocarbon processing site and/or the various components thereof. As should be appreciated, such components may include filters, condensers, separators, storage tanks, pig receivers, etc.

Such combustion engines generate and output exhaust gases via an exhaust stack. The exhaust gas may undergo treatments (e.g., via an exhaust system) and then be released to the environment. For example, the exhaust system may include aftertreatments such as one or more catalytic converters, selective catalytic reduction (SCR) systems having ammonia ($NH_3$) or urea injection, ammonia slip catalyst (ASC) systems, oxidation catalyst (OXI-CAT) systems, 2-way or 3-way catalysts, etc. As discussed herein, a combi-flare may include at least a portion of an exhaust stack and a flare section to enjoin the benefits of a flare to the exhaust stack of one or more combustion engines or other combustion systems (e.g., boiler, furnace, etc.). Indeed, the components of an exhaust stack may be suitable for the high temperature environment of the flaring, and implementing the exhaust stack and flare together via a combi-flare may reduce manufacturing expenses, such as separate stacks for exhaust and flaring, as well as additional piping for the separate exhaust stacks and flares, while improving efficiency (e.g., manufacturing and/or operating efficiency). For example, by directing the exhaust gas of one or more combustion engines to the combi-flare for flaring, exhaust system components (e.g., silencer, filter, secondary air injections, etc.) and/or aftertreatments (e.g., oxidation-catalyst, ammonia slip catalyst (ASC), etc.) may be reduced or eliminated. The combi-flare may also eliminate a separate exhaust burner, which could otherwise be included in an exhaust stack. Furthermore, the burning of the exhaust gas via the combi-flare may lower the net emissions of undesirable compounds (e.g., carbon monoxide, nitrogen oxides (NOx), sulfur oxides (SOx), particulate matter, unburnt hydrocarbons (e.g., Methane, Ethane, Propane, Butane, and so on and any isomers thereof), $H_2$, $H_2S$, $NH_3$, CO, $C_2H_2$, $C_2H_4$, $C_3H_6$, etc.) that would otherwise be output via a separate flare and exhaust stack. For example, excess oxygen in the exhaust gas could help reduce the need for additional oxygen for flaring the OGs and/or unburnt fuel/hydrocarbons in the exhaust gas may more readily burn with the OGs associated with the flare. As such, the combi-flare may reduce costs, reduce the footprint of the site/plant, and potentially reduce overall emissions by combining the flows together.

With the foregoing in mind, FIG. 1 is a schematic block diagram of an embodiment of a hydrocarbon processing site 10 including hydrocarbon processing systems 12 (e.g., 12A and 12B) to treat a process fluid 14 (e.g., natural gas or other hydrocarbon), one or more engines 16, one or more controllers 18, and a combi-flare 20. An engine 16 may be coupled to and drive one or more loads such as a process fluid pump 22 (e.g., gas compressor) via a mechanical coupling 24 (e.g., shaft, piston rod, etc.). As should be appreciated, the process fluid pump 22 is given as a non-limiting example of an engine load, and engines 16 may be utilized for any suitable mechanical work associated with the hydrocarbon processing site 10. Indeed, the process fluid pump 22 may be driven by an electrical motor, and one or more engines 16 may be utilized for other functions of the hydrocarbon processing site 10.

The process fluid pump(s) 22 may motivate the flow of the process fluid 14 from upstream systems 26 (e.g., hydrocarbon production facilities such as wells, other hydrocarbon processing sites 10, etc.), through the hydrocarbon processing site 10, and/or to downstream systems 28 (e.g., distribution facilities, storage facilities, end users, other hydrocarbon processing sites 10, etc.). As should be appreciated, the process fluid 14 may be in any suitable state (e.g., liquid, gas, or mixture thereof) and undergo any suitable treatment/processing via pre-pump hydrocarbon processing systems 12A and/or post-pump hydrocarbon processing systems 12B. For example, the hydrocarbon processing systems 12 may include one or more individual components 30 in series or parallel such as pig receivers, emergency shutdown valves, bypass valves, slug catchers, storage tanks, emulsion breakers, filters, separators, dryers, scrubbers, etc. Additionally, in some embodiments, the controller 18 and/or one or more auxiliary controllers 32 having one or more processors 34 and memory 36 may be utilized to control operations of the hydrocarbon processing systems 12. For example, one or more sensors 38 may provide real-time feedback to the controller 18 and/or auxiliary controllers 32 for operating the individual components 30. As should be appreciated, the individual components 30 of the hydrocarbon processing systems 12 may vary based on the type/purpose of the hydrocarbon processing site 10. Furthermore, the individual components 30 of the hydrocarbon processing systems 12 are given as non-limiting examples, and additional or fewer individual components 30 may be employed.

Additionally, as should be appreciated, the processor(s) 34 may be used to execute software, such as software for operating the engine 16, the combi-flare 20, one or more individual components 30, and so forth. Moreover, the processor(s) 34 may include multiple microprocessors, one or more "general-purpose" microprocessors, one or more special-purpose microprocessors, and/or one or more application specific integrated circuits (ASICs), or some combination thereof. For example, processor(s) 34 may include one or more reduced instruction set (RISC) processors. Additionally, the memory 36 may include a volatile memory, such as random access memory (RAM), and/or a nonvolatile memory, such as read-only memory (ROM). The memory 36 may store a variety of information and may be used for various purposes. For example, the memory 36 may store processor-executable instructions (e.g., firmware or software) for the processor 34 to execute. The storage device(s) (e.g., nonvolatile storage) may include ROM, flash memory, a hard drive, or any other suitable optical, magnetic, or solid-state storage medium, or a combination thereof.

In some scenarios, the hydrocarbon processing systems 12 may separate or accumulate speciated organic gases (OGs) 40 and/or additional compounds that are desired to be disposed of, for example, via flaring. The OGs 40 and/or other undesirable compounds may be directed to the combi-flare 20 for burning, as discussed further below. Such OGs 40 may include compounds unsuitable to continue in the flow of the process fluid 14 and/or excess process fluid 14. For example, during startup, shutdown, and/or emergency scenarios, excess process fluid 14 at one or more individual components 30 of the hydrocarbon processing systems 12 and/or the process fluid pump 22 may be routed to the combi-flare for burning. As a non-limiting example, the process fluid pump 22 (e.g., a gas compressor system) may include a packing (i.e., seal around a piston rod driving the process fluid pump 22) that leaks (via controlled or uncontrolled seepage) process fluid 14 and/or other fugitive gases therethrough (e.g., from a compression chamber of the process fluid pump 22 through the packing). The leaked fugitive gases may be collected and/or directed to the combi-flare for combustion. As should be appreciated, OGs 40 and/or other compounds may be routed to the combi-flare 20 continuously, periodically, and/or in response to certain conditions such as over-pressurization, startup, shutdown, etc. For example, OGs 40 may be routed to the combi-flare 20 via a bypass valve to prevent over-pressurization during startup or shutdown of one or more hydrocarbon processing systems 12 and/or a process fluid pump 22. Indeed, the combi-flare 20 may be utilized for routine flaring, safety flaring, excess flaring, or startup flaring.

Additionally, in some embodiments, a heat shield 41 may be disposed between the flame of the combi-flare 20 and the components of the hydrocarbon processing site 10, such as the engine 16 or hydrocarbon processing systems 12. The heat shield 41 may be of any suitable material (e.g., capable of withstanding the heat of the flame of the combi-flare 20) and formed in any suitable manner. For example, the heat shield 41 may include barrier walls, a ceiling of a structure, and/or a floor of a structure. Moreover, the heat shield 41 may provide additional utility by dampening or redirecting sound or light in addition to heat.

As discussed herein, the engine(s) 16 may be of any suitable type of internal combustion engine such as but not limited to a turbine engine, a rotary engine, or a reciprocating internal combustion engine having one or more pistons that reciprocate within respective cylinders. During operation, an engine 16 generates exhaust gas 42 from the internal combustion process. As discussed further below, the exhaust gas 42 may be processed (e.g., via an exhaust system and/or aftertreatment) and sent to the combi-flare 20 to burn any unburnt hydrocarbons and/or trace species and/or release the exhaust gas to the atmosphere. Although the exhaust gas 42 may include OGs, for clarity and distinction, as used herein, the OGs 40 are referred to as the portions of the process fluid 14, separated or not, that are desired to be flared and the exhaust gas 42 is referred to as the byproduct of a combustion process. The controller 18 may control operations of the engine 16 and/or the combi-flare 20. For example, sensors 38 within the engine 16, at the combi-flare, and/or along the flow paths of the OGs 40 and/or exhaust gases 42 may be used to regulate operation of the combi-flare 20 and/or engine 16.

Figure 2:
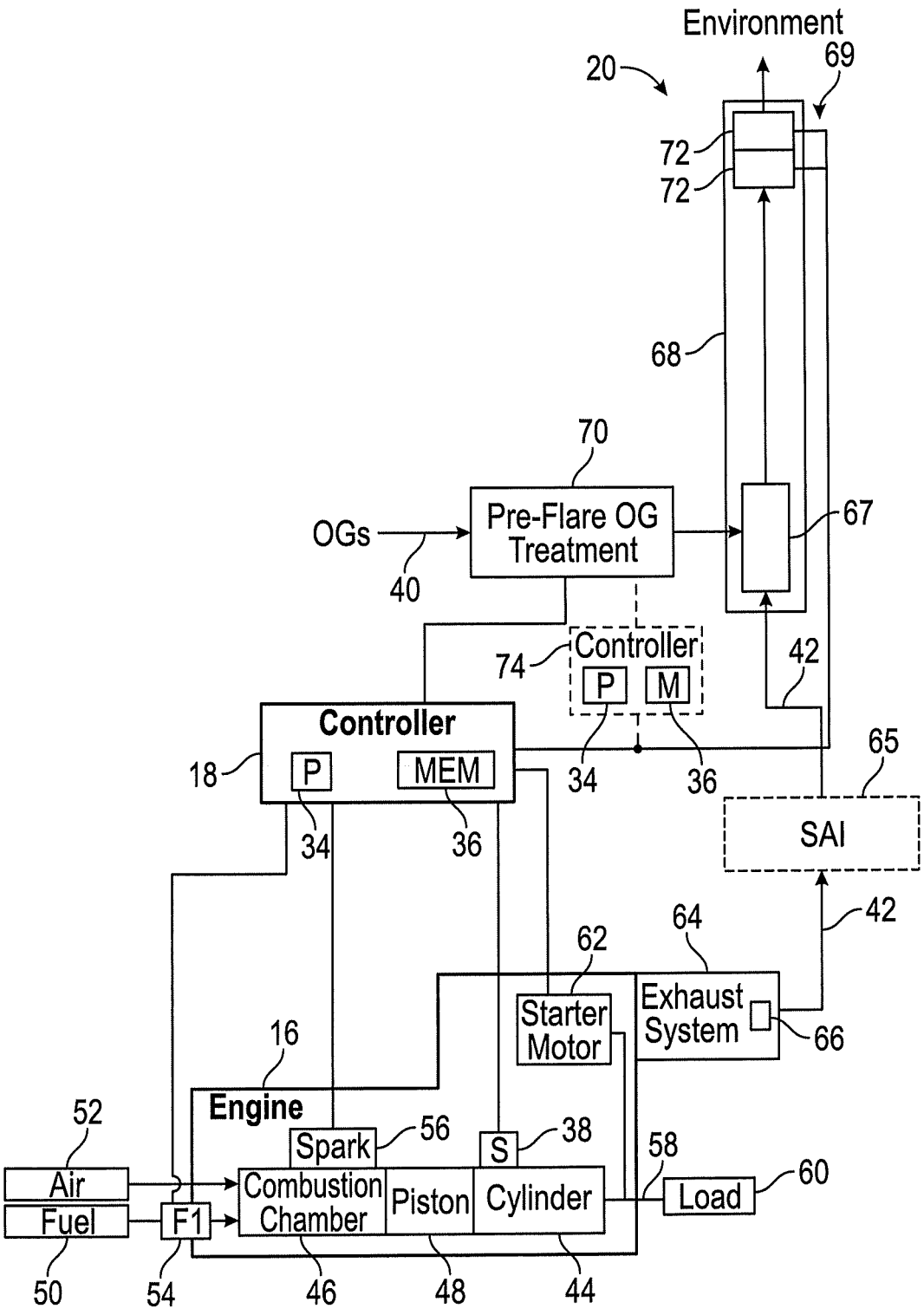
FIG. 2 is a schematic block diagram of an engine outputting exhaust gas to a combi-flare that also receives speciated organic gases (OGs), in accordance with an embodiment.

To help illustrate, FIG. 2 is a schematic block diagram of an engine 16 outputting exhaust gas 42 to a combi-flare 20 that also receives OGs 40. As noted above, the engine 16 may be a reciprocating engine, as depicted, or any suitable combustion engine. For example, the engine 16 may include one or more cylinders 44 (e.g., 1, 2, 3, 4, 5, 6, 8, 10, 12, 14, 16, 18, 20, or more cylinders 44) and a combustion chamber 46 is positioned adjacent to each cylinder 44 with a piston 48 is disposed within each cylinder 44. Each combustion chamber 46 is configured to receive fuel 50 and air 52. During operation of the engine 16, fuel 50 and air 52 are provided to each combustion chamber 46, thereby forming a fuel/air mixture. The fuel/air mixture may be controlled by a fuel admission device 54 (e.g., fuel injector) that controls a flow rate of the fuel 50 into the respective combustion chamber 46. For example, the engine 16 may include one, two, or more fuel admission devices 54 for each combustion chamber 46. A spark source 56 (e.g., spark plug) ignites the fuel/air mixture, thereby inducing combustion of the fuel/air mixture. The combustion generates expanding exhaust gases 42 that drive the piston 48 away from the respective combustion chamber 46 within the respective cylinder 44. The motion of each piston 48 drives a crankshaft 58 to rotate, which, in turn, drives a load 60 such as the process fluid pump 22 or other mechanical load of the hydrocarbon processing site 10. In addition, a starter 62 (e.g., electric starter motor or pneumatic starter) may be selectively coupled to the crankshaft 58 during start-up of the engine 16 to drive the crankshaft 58 to rotate during the start-up process. For example, in some embodiments, the starter 62 may be a pneumatic starter utilizing compressed air or pressurized process fluid 14 to motivate the engine 16 to start.

In general, pneumatic starters that utilize pressurized process fluid 14 (e.g., pressurized natural gas) may disperse the process fluid 14 to the environment after use. However, in some embodiments, the otherwise released process fluid 14 may be directed to the combi-flare 20 (e.g., via exhaust system 64, a channel coupled to the exhaust system output) to be combusted with minimal extra piping or via separate piping. Indeed, by utilizing at least a portion of the same exhaust piping as the exhaust system 64, the process fluid 14 utilized in starting the engine 16 (e.g., via a pneumatic starter) may be combusted, further reducing emissions while minimally effecting cost. As discussed further below, the hydrocarbon processing site 10 may include multiple engines 16 that feed exhaust gas 42 to a single combi-flare 20. In some embodiments, the engines 16 may have the same or different starters 62. For example, a first engine 16 (e.g., having/directly coupled to the exhaust stack of the combi-flare 20) may include an electric starter, while additional engines 16 include pneumatic starters that utilize process fluid 14, the waste of which is directed to the combi-flare 20 upon starting of the additional engines 16.

In some embodiments, the controller 18 may be coupled to the engine 16 and act as an engine control unit (ECU). For example, the controller 18 may control a throttle of the engine 16, the flow rates of air 52 and fuel 50 into the engine 16, the direction of fluids (e.g., coolant, lubricant) through the engine 16 and/or additional parameters based on sensor feedback. Such sensors 38 may include but are not limited to gas composition sensors (e.g., oxidant sensors, lambda sensors, $NO_X$ sensors, CO sensors, $CO_2$ sensors, and OG sensors), flow sensors, temperature sensors (e.g., coolant temperature sensors, lubricant temperature sensors, intake manifold temperature sensors, compressor discharge temperature sensors), vibration sensors, knock detection sensors, compressor rod load sensors, pressure sensors (e.g., intake manifold pressure sensors), speed sensors (e.g., tachometers), microphones, or any combination thereof. Furthermore, in some embodiments, the controller 18 may adjust the flow rates of the air 52 and fuel 50 to maintain a particular air-to-fuel ratio, which may vary based on implementation. For example, the air-to-fuel ratio may be stoichiometrically balanced, fuel lean, or fuel rich. As should be appreciated, a perfect stoichiometric balance may be difficult or impractical to achieve in a realistic scenario. As such, as used herein, stoichiometric operation may refer to operation of the engine 16 with lambda values (i.e., air-to-fuel equivalence ratios) between 0.990 and 1.100. Furthermore, lean burn operation may be considered to have lambda values greater than 1.100, and rich burn (e.g., sub-stoichiometric) operation may be considered to have lambda values less than 0.990. However, even when operated in an attempted stoichiometrically balanced air-to-fuel ratio, the exhaust gas 42 of the combustion process may include some oxygen content and/or fuel content. Moreover, lean or rich air-to-fuel ratios may have greater levels (i.e., relative to a stoichiometric air-to-fuel ratio) of incomplete combustion and, therefore, higher oxygen and/or fuel content in the exhaust gas 42. In some embodiments, the controller 18 may adjust operation of the engine 16 to maintain a particular content (e.g., excess or reduced fuel 50 and/or oxygen) of the exhaust gas 42 that assists with the flaring of the combi-flare 20 depending on implementation.

In general, such exhaust gases 42 are treated via an exhaust system 64 of the engine 16 and/or via auxiliary treatments such as an aftertreatment 66 before being released to the environment. In general, the exhaust system 64 may include noise reducers (e.g., mufflers/silences), flame arrestors, filters, heat exchangers, and/or a secondary air injection (SAI) 65 prior to being expelled to the environment as well as one or more aftertreatments 66 (also known as exhaust gas treatments). Furthermore, in some scenarios, the exhaust system 64 may include a turbine stage of a turbo charger for forced induction of the air 52 into the engine 16. In general, SAI 65 provides air to the stream of exhaust gas 42 to allow for fuller secondary combustion of exhaust gases 42 due to the introduction of additional oxygen within the air. In some scenarios, use of SAI 65 depends on implementation such as the mode of operating the engine 16. For example, SAI 65 may be utilized when the engine 16 is operated stoichiometrically and omitted or used less in lean-burn operations. Moreover, while shown after the exhaust system 64, as should be appreciated, the SAI 65 may introduce air at any point in the exhaust gas flow path.

Additionally, in some embodiments, aftertreatment 66 may be performed to reduce or process trace species within the exhaust gas 42. Such trace species may include but are not limited to carbon oxides ($CO_X$) such as carbon dioxide ($CO_2$) and carbon monoxide (CO), sulfur oxides ($SO_X$) such as sulfur dioxide ($SO_2$), nitrogen oxides ($NO_X$) such as nitric oxide (NO) and nitrogen dioxide ($NO_2$), nitrous oxide ($N_2O$), unburned hydrocarbons (UHC), Formaldehyde ($CH_2O$), ammonia ($NH_3$), mercury (Hg). In some embodiments, the aftertreatment 66 may utilize one or more catalysts to reduce/remove the exhaust gas trace species such as catalytic converters, selective catalytic reduction (SCR) systems having ammonia ($NH_3$) or urea injection, ammonia slip catalyst (ASC) systems, oxidation catalyst (OXI-CAT) systems, 2-way or 3-way catalysts, etc. As non-limiting examples, a three-way catalyst may be utilized during stoichiometric operations of the engine 16 and an oxidation catalyst may be utilized during lean burn operations with an optional SCR system with ammonia slip catalyst (ASC).

After treatment/processing, the exhaust gas 42 may be mixed (e.g., via a mixing chamber 67) with OGs 40 and flow through an exhaust stack 68. The mixing chamber 67 may be active or passive and promotes homogeneity of the combined flow stream (e.g., to increase destruction efficiency) prior to combustion via the flare section 69 of the combi-flare 20 and release to the environment. In some embodiments, the mixing chamber 67 may be integral with or coupled to the exhaust stack 68 or implemented prior to the exhaust stack 68 such that the combined flow stream is introduced into the exhaust stack 68. Furthermore, when utilized with the SAI 65, the mixing chamber 67 may receive air from the SAI 65, the exhaust gas 42, and the OGs 40 individually or the air from the SAI 65 may be introduced to the exhaust gas 42 upstream of the mixing chamber 67.

In general, the exhaust stack 68 may direct the exhaust gas 42 away from (e.g., higher than) other components or people in the vicinity. As discussed herein, the exhaust stack 68 of the engine 16 may be incorporated with a combi-flare 20 to combine the elements of the exhaust stack 68 with those of a flare to burn OGs 40. As such, the exhaust gas 42 of the engine 16 may be burned, via the combi-flare 20, with or without the OGs 40 from other components of the hydrocarbon processing site 10. By burning the exhaust gas 42, traces species and/or fuel content may be further reduced or eliminated prior to being expelled to the environment, reducing emissions. Moreover, the fuel content and/or oxygen content of the exhaust gas 42 may increase the completeness of the combustion of the OGs 40 (e.g., destruction efficiency) at the combi-flare 20 to further reduce the overall emissions of the hydrocarbon processing site 10 (e.g., relative to using a separate flare and exhaust stack 68). Furthermore, in some scenarios, the exhaust gas 42 may act as a diluent relative to the OGs 40 such that the temperature of the flame (e.g., at the flare section 69) is lowered and/or maintained at a desired level. For example, the exhaust gas 42 may reduce the temperature of the flame such that less/undesired emissions (e.g., $NO_x$) are reduced while maintaining a high enough temperature for efficient/effective combustion. Indeed, the exhaust gas 42 may have a higher heat capacity than the OGs 40 and/or cause endothermic reactions (e.g., disassociation of $CO_2$ and $H_2O$) which may help lower temperature. Moreover, such reactions may also reduce the concentration/chemical availability of oxygen that may otherwise generate undesired byproducts in implementations that do not use exhaust gas 42. In some embodiments, the ratio of OGs 40 and exhaust gas 42 may be regulated (e.g., via the controller 18, 74) to maintain a temperature of the flame within one or more thresholds.

As should be appreciated, the exhaust stack 68 may be any vertical conduit or stack leading to an upper flare section 69 (e.g., flare tip). The exhaust stack 68 serves dual purposes of receiving and providing the exhaust gas 42 and OGs 40 to the flare section 69 for flaring both the OGs 40 and other elements in the exhaust gas 42.

Moreover, when utilizing the combi-flare 20 to burn the exhaust gas 42, one or more components of the exhaust system 64, aftertreatment 66, or flare may be eliminated, as burning the exhaust gas 42 may reduce or eliminate trace species or other content that would otherwise be have been treated via the exhaust system 64 and/or aftertreatment 66. For example, as hydrocarbons remaining in the exhaust gas 42 leaving the combustion chamber 46 may be combusted via the combi-flare 20, oxidation-catalysts of the aftertreatment 66 may be omitted. Moreover, for aftertreatments 66 that include an SCR system with ammonia or urea injection, the ASC may be omitted, as ammonia/urea may be combusted by the combi-flare, reducing or eliminating the reason for the ASC. Furthermore, in embodiments that would otherwise utilize an air-assisted flare, the SAI 65 may supplement or supplant air-assistance components (discussed further below) of the combi-flare 20, further increasing efficiency and reducing costs. Conversely, embodiments with an air-assisted combi-flare 20 may omit the SAI 65 from the exhaust system 64.

By directing the undesired OGs 40 from different parts of the hydrocarbon processing site 10 to the exhaust stack 68 of one or more engines 16 and burning the exhaust gas 42 of the engine(s) 16 with the OGs 40, the total destruction efficiency of the OGs 40 and content of the exhaust gas 42 may be increased. As should be appreciated, as used herein, "burning" of the exhaust gas 42 is meant as the burning of combustible portions (e.g., unburnt hydrocarbons, combustible trace species, etc.) of the exhaust gas 42 and/or the use of oxygen in the exhaust gas 42 to enhance/facilitate combustion of the OGs 40. Indeed, the burning of the exhaust gas 42 may reduce the content of undesired compounds such that would otherwise be removed via the exhaust system 64 and/or aftertreatment 66. As such, the combi-flare 20 may further reduce costs and increase efficiency by reducing the usage of exhaust system components (e.g., portions of the aftertreatment 66). Additionally, while discussed herein as burning the OGs 40 and exhaust gas 42 together, in certain operations, the combi-flare 20 may be used to burn only the OGs 40 or only the exhaust gas 42 while retaining at least a portion of the benefits suggested above. Moreover, in some scenarios, the combi-flare 20 may disengage the flaring aspect, such as if no OGs 40 are to be burned and the exhaust gas composition is within desired limits (e.g., regulatory requirements).

In some embodiments, the controller 18 (e.g., the same controller 18 that controls the engine 16) and/or a separate controller 74 may control the function of pre-flare OG treatment 70 and/or flaring components 72. For example, the controller 18 or the separate controller 74 may receive input from sensors 38 along the flow paths of the OGs 40 (e.g., from the hydrocarbon processing systems 12) and/or exhaust gas 42 (e.g., before and/or after the exhaust system 64 (e.g., before or after the aftertreatment 66), before and/or after the SAI 65, and/or along the exhaust stack 68 (e.g., before and/or after the mixing chamber 67) to regulate the flaming of the OGs 40 and exhaust gas 42. For example, the sensors 38 may include oxidant (e.g., oxygen) sensors, lambda sensors, $NO_X$ sensors, CO sensors, $CO_2$ sensors, and OG sensors, temperature sensors, etc. Additionally, in some embodiments, one or more emissions sampling ports (not shown) may be disposed before and/or after the aftertreatment 66, for example, to monitoring viability of the aftertreatment system components (e.g., catalysts), to calculate species specific conversion efficiencies, and/or for regulatory compliance. As should be appreciated, emissions sampling ports may be operationally coupled to stationary or portable external monitoring equipment.

As stated above, traditional flares may be non-assisted, air-assisted, pressure-assisted, steam-assisted, etc. While the combi-flare 20 is effectively exhaust-gas-assisted during operation of the engine 16, additional pre-flare OG treatments 70 and/or one or more flaring components 72 may be implemented to provide air, pressure, or steam assistance to the combi-flare 20 and/or for ignition of the flame.

Figure 3:
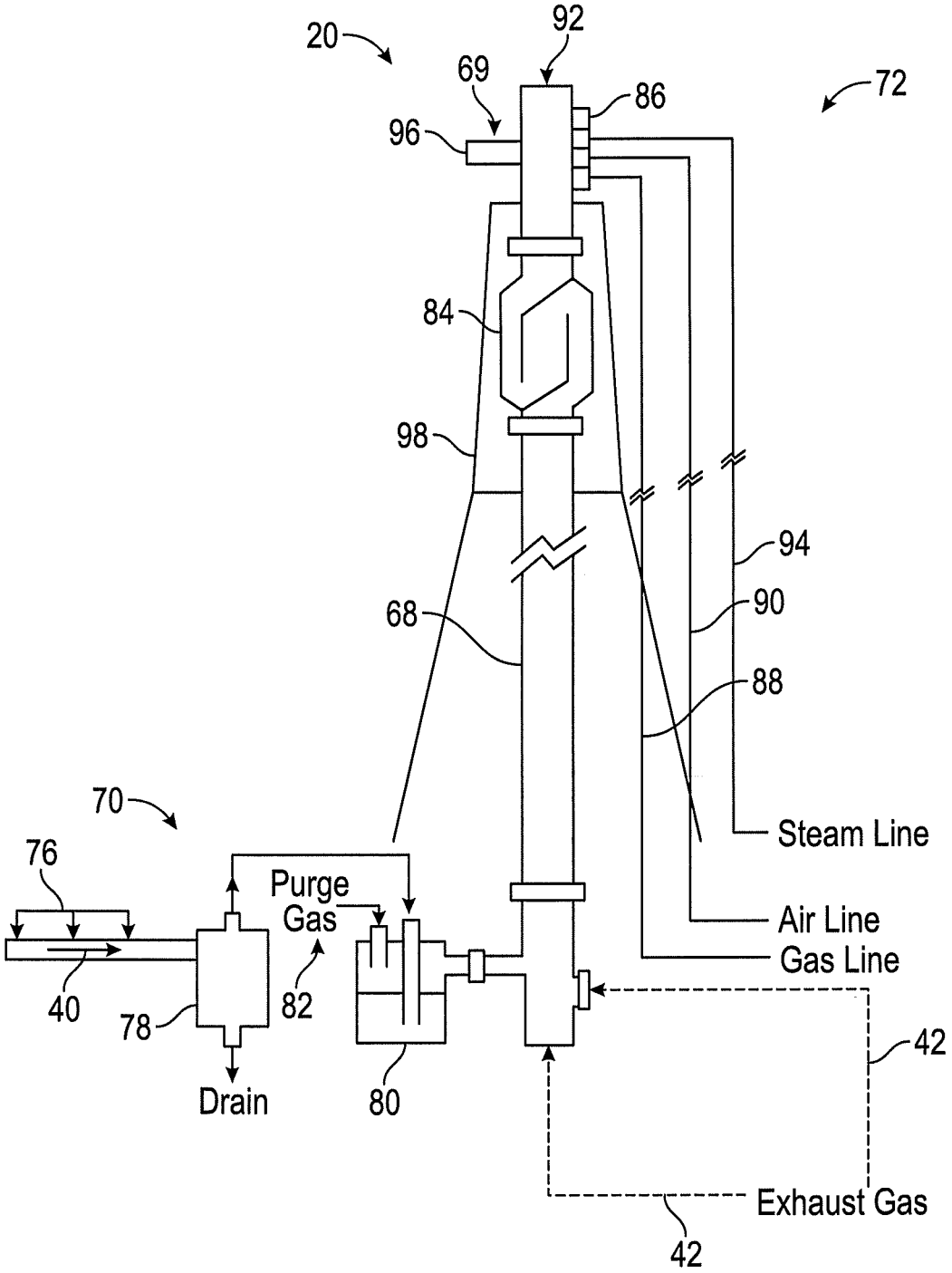
FIG. 3 is a schematic view of the combi-flare including pre-flare OG treatments and flaring components for steam-assisted flaring, in accordance with an embodiment.

FIG. 3 is a schematic view of the combi-flare 20 including pre-flare OG treatments 70 and flaring components 72 for steam-assisted flaring. In some embodiments, the pre-flare OG treatments 70 may include a collection header 76 that collects the OGs 40 from one or multiple sources (e.g., individual components 30 of the hydrocarbon processing systems 12). Additionally, a knock-out drum 78 may be used to catch liquid OGs 40, which may be drained or heated to promote evaporation to a gaseous state. In some embodiments, a liquid seal 80 may be used to block or arrest flame flashbacks if the flame travels down the exhaust stack 68. The liquid seal 80 also acts as a mechanical damper for shock waves that may occur due to the burning of the OGs 40 and exhaust gas 42. In some embodiments, a purge gas 82 may be introduced (e.g., via the liquid seal 80) to provide backpressure on the upstream components of the pre-flare OG treatment 70 and/or to reduce the likelihood of flashback by providing positive flow through the exhaust stack 68 in the scenario of low flow rates of OGs 40 and/or exhaust gas 42. In some embodiments, the exhaust gas 42 may provide such positive flow and reduce the likelihood of flashbacks (e.g., depending on exhaust gas content) to supplement or supplant the purge gas 82. Additionally or alternatively to the liquid seal 80, flame arrestors and/or check valves may be utilized to help prevent flashback.

The flaring components 72 may include a gas seal 84 to reduce the likelihood of flashback (e.g., due to wind or thermal contraction of stack gases) as well as a pilot burner 86 to maintain the flame. The pilot burner 86 may be supplied by a gas line 88 and/or an air line 90 and may include an ignition device to generate a flame. In air-assisted implementations, the air line 90 or an auxiliary air line may provide forced air at the flare tip 92 of the flare section 69 to mix the air and OGs 40/exhaust gas 42 and to provide additional oxygen to increase the destruction efficiency of the OGs 40 and exhaust gas 42. In steam-assisted implementations, a steam line 94, in addition to or separate from the air line 90, may provide steam to one or more steam nozzles 96 that promote mixing and provide for smokeless flaring, to inhibit particulate matter forming in the combustion, combustion shaping, noise suppression, and/or thermal protection of components. Furthermore, in some embodiments, the steam may be generated via heat recovery from the engine 16 (e.g., via a liquid-to-liquid heat exchanger of the engine cooling system) or the exhaust flow (e.g., post aftertreatment 66 and prior to the mixing chamber 67). As should be appreciated, the particular pre-flare OG treatments 70 and flaring components 72 of FIG. 3 are given as non-limiting examples, and additional, different, or fewer components may be utilized depending on implementation (e.g., air-assisted, pressure-assisted, steam-assisted, etc.). Furthermore, in some embodiments, SAI 65 or air-assistance may be utilized while omitting the other to increase efficiency and reduce complexity and cost of the system.

Figure 4:
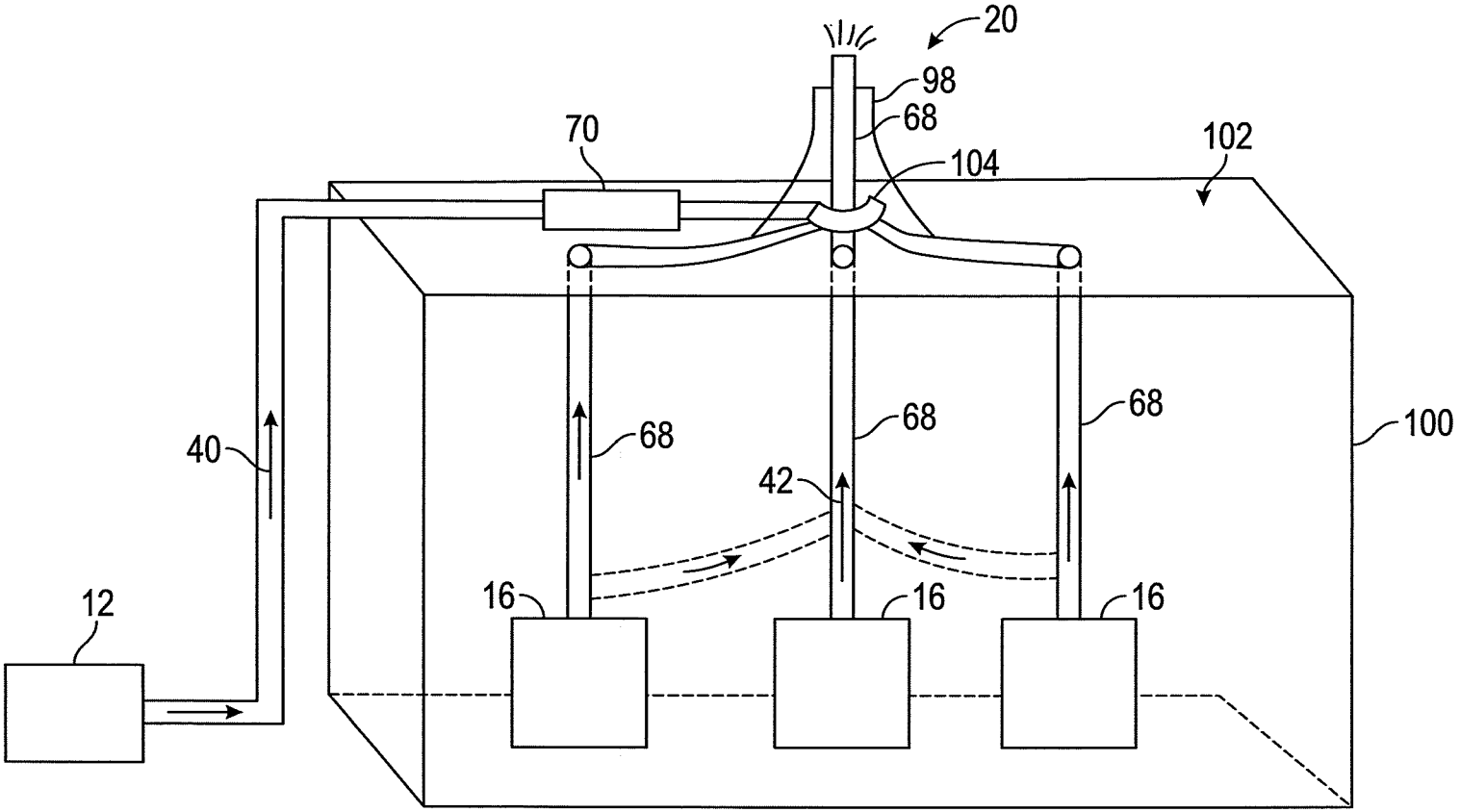
FIG. 4 is a schematic view of a building with a combi-flare disposed on top, in accordance with an embodiment.

Depending on implementation, the exhaust stack 68 may be extended to a height greater than traditional exhaust stacks to provide additional distance between the flare tip 92 and components or people in the vicinity. To stabilize the exhaust stack 68 at increased heights, the exhaust stack 68 may include additional support structure 98. As such the exhaust stack 68 may be self-supported, derrick-supported, guy-wire supported, etc. depending on implementation such as the desired height of the flare tip 92. In some embodiments, a heat shield 41 may be utilized to reduce the overall height of the exhaust stack 68 while maintaining operational safety. Additionally or alternatively, the exhaust stack 68 may be implemented on top of a building 100, and the roof 102 of the building 100 may be implemented, at least in part, as a heat shield 41, as shown in FIG. 4. In some embodiments, one or more engines 16 may be disposed within a building 100 for shelter from the elements (e.g., sunlight, rain, wind, hail, snow, heat, cold, etc.) and/or to shelter the environment from heat or noise generated by the engines 16 or loads 60. The exhaust stacks 68 of the engines 16 may be individually or collectively routed to the combi-flare 20 where a combined exhaust stack 68 provides the basis for the combi-flare 20. For example, the flare tip 92 of the combi-flare 20 may be disposed on the combined portion of the exhaust stack 68. In some embodiments, a manifold 104 may combine the exhaust stacks 68 of multiple engines 16. Additionally or alternatively, the manifold 104 may combine the exhaust gases 42 with the OGs 40. As should be appreciated, the exhaust stack 68 may be implemented on the roof 102 of any suitable building 100, whether the engines 16 are inside of the building 100 or not. Moreover, other structures may also be used to, at least partially, support the combi-flare 20. For example, the combi-flare 20 may be disposed on, coupled to, and/or supported by retaining walls/enclosures, sound walls/enclosures, etc. Moreover, such retaining or sound walls, enclosures, or structures may be used to isolate the combi-flare 20 from other components of the hydrocarbon processing site 10.

Figure 5:
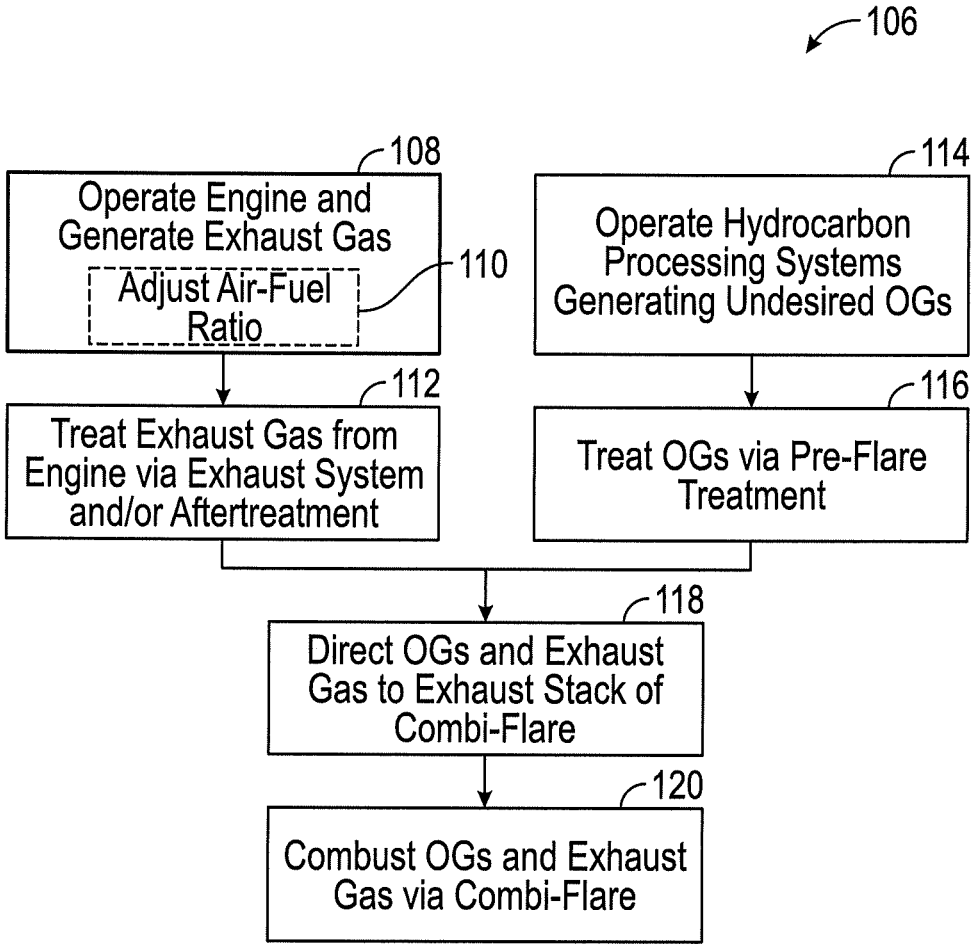
FIG. 5 is a flowchart of an example process for utilizing a combi-flare to combust exhaust gas and OGs, in accordance with an embodiment.

FIG. 5 is a flowchart 106 of an example process for utilizing a combi-flare 20 for undesired OGs 40 and engine exhaust gas 42. In general, one or more engines 16 are operated, for example to drive a load 60 of the hydrocarbon processing site 10, and exhaust gas 42 is generated therefrom (process block 108). In some embodiments, the air-fuel-ratio may be adjusted (e.g., via controller 18) (process block 108), which may alter the composition of the exhaust gas 42. As should be appreciated, the air-fuel-ratio may be adjusted to optimize the operation of the engine 16 and/or to adjust the composition of the exhaust gas 42. The exhaust gas is treated via the exhaust system 64 and/or aftertreatment 66 (process block 112). As discussed above, in some embodiments, portions of the exhaust system 64 and/or aftertreatment 66 may be omitted, compared to what would otherwise be included if the exhaust gas 42 was released to the environment without burning due to the eventual burning of the exhaust gas 42 via the combi-flare 20. Additionally, hydrocarbon processing systems 12 may be operated that generate undesired OGs 40 (process block 114). As discussed above, the undesired OGs 40 may be OGs 40 unsuitable to be included in the flow of the process fluid 14 and/or may include excess process fluid 14. The OGs 40 are also treated via pre-flare treatments (process block 116) such as, for example, by passing through a knock-out drum 78 and/or a liquid seal 80. The OGs 40 and the exhaust gas 42 are directed to an exhaust stack of a combi-flare (process block 118), and the OGs 40 and exhaust gas 42 are combusted together via the combi-flare (process block 120).

As should be appreciated, the engine 16 and hydrocarbon processing systems 12 discussed herein are given as non-limiting examples, and any suitable engine 16 and OG source may provide OGs 40 and exhaust gas 42 to the discussed combi-flare 20 to utilize the techniques described herein. Furthermore, while discussed herein as providing the OGs 40 to an exhaust stack 68 of an engine 16, in some embodiments, the exhaust gas 42 may be provided to a flare stack of a flare. For example, if an existing flare is already in use, the exhaust gas 42 of one or more engines 16 may be introduced into the flare stack to burn the exhaust gas 42 with the OGs 40, which may reduce the overall emissions of the OGs 40 and exhaust gases 42. Furthermore, while discussed above as exhaust gas 42 from an engine 16, exhaust gas 42 from any suitable combustion process (e.g., boiler, furnace, etc.) may be utilized by the combi-flare 20. Additionally, although the flowchart 106 is shown with particular process blocks in a given order, in certain embodiments, process/decision blocks may be reordered, altered, deleted, and/or occur simultaneously. Additionally, the flowchart 106 is given as an illustrative tool and further decision and process blocks may also be added depending on implementation.

Technical effects of the disclosed embodiments include providing systems and methods for utilizing a combi-flare 20 to combust a mixture of OGs 40 from one or more hydrocarbon processing systems 12 and exhaust gas 42 from one or more combustion processes. The disclosed embodiments may enable increased efficiency in layout and/or manufacturing (e.g., elimination of separate flare stacks and exhaust stacks, reduced piping for separate stacks, etc.) of a hydrocarbon processing site 10. In addition, the disclosed embodiments may enable increased completeness (i.e., destruction efficiency) in combusting undesired compounds for a reduced net emission of such undesired compounds.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112 (f).

The invention claimed is:

1. A hydrocarbon processing site comprising:

an internal combustion engine configured to, during operation, generate an exhaust gas;

a hydrocarbon processing component configured to:

receive a process fluid;

output a first portion of the process fluid via a first outlet; and output a second portion of the process fluid via a second outlet; and a combi-flare comprising:

an exhaust stack of the internal combustion engine, the exhaust stack configured to receive the second portion of the process fluid and the exhaust gas, wherein the second portion of the process fluid and the exhaust gas operationally mix within the exhaust stack; and a flare section configured to generate a flame to burn a mixture of the second portion of the process fluid and the exhaust gas, wherein the exhaust gas is a product of combustion in the internal combustion engine, and the second portion of the process fluid comprises one or more speciated organic gases (OGs).

2. The hydrocarbon processing site of claim 1, wherein the second portion of the process fluid comprises at least a portion of a fluid flow from a pump, a compressor, a seal or packing, a pneumatic starter, or any combination thereof.

3. The hydrocarbon processing site of claim 1, wherein the second portion of the process fluid comprises a leaked fluid, a fugitive gas, an over-pressure fluid, an overflow fluid, an emergency relief fluid, or any combination thereof.

4. The hydrocarbon processing site of claim 1, wherein the exhaust stack comprises a mixing chamber configured to individually receive the process fluid comprising the one or more OGs and the exhaust gas.

5. The hydrocarbon processing site of claim 1, wherein the hydrocarbon processing component comprises a valve configured to direct the second portion of the process fluid to the combi-flare via the second outlet in response to a flow condition of the process fluid, wherein the flow condition comprises an over-pressurization condition, a volumetric overflow condition, an emergency relief condition, or any combination thereof.

6. The hydrocarbon processing site of claim 5, wherein the flow condition is associated with a startup or shutdown process of at least a portion of the hydrocarbon processing site.

7. The hydrocarbon processing site of claim 1, wherein the hydrocarbon processing component is configured to extract the one or more OGs from the process fluid, and wherein the second portion of the process fluid comprises an operationally continuous flow of the one or more OGs extracted from the process fluid.

8. The hydrocarbon processing site of claim 3, comprising a collection header coupled to a plurality of components including the hydrocarbon processing component, each of the plurality of components is configured to provide a portion of the process fluid to the collection header, and the collection header is configured to output a combination of the portions of the process fluid for delivery to the exhaust stack.

9. The hydrocarbon processing site of claim 1, wherein the exhaust stack comprises a first inlet configured to receive the second portion of the process fluid and a second inlet configured to receive the exhaust gas.

10. The hydrocarbon processing site of claim 1, comprising a pneumatic engine starter configured to use the process fluid as a motive fluid to initiate an engine start, wherein the hydrocarbon processing component comprises the pneumatic engine starter, and wherein an output of the pneumatic engine starter comprises the second outlet.

11. The hydrocarbon processing site of claim 1, wherein the internal combustion engine is disposed within a building and the combi-flare is disposed on top of the building, wherein a roof of the building is configured to operate as a heat shield for the flame.

12. The hydrocarbon processing site of claim 1, wherein the internal combustion engine is configured to operate on a lean burn combination of fuel and oxygen having a lambda (2) greater than or equal to 1.100, and wherein the internal combustion engine comprises an exhaust system configured to treat the exhaust gas via an aftertreatment prior to being received by the exhaust stack.

13. The hydrocarbon processing site of claim 1, wherein the hydrocarbon processing component comprises a process fluid pump configured to pressurize and motivate a flow of the process fluid, wherein an output of a packing of the process fluid pump comprises the second outlet.

14. The hydrocarbon processing site of claim 13, wherein the internal combustion engine is configured to drive the process fluid pump via a piston rod disposed, at least in part, within the packing.

15. A method comprising:

generating, via an internal combustion engine, an exhaust gas;

receiving, via a first inlet of an exhaust stack of the internal combustion engine, the exhaust gas;

receiving, via a second inlet of the exhaust stack, a process fluid comprising one or more speciated organic gases (OGs) desired to be disposed of via combustion;

mixing, within the exhaust stack, the exhaust gas and the process fluid comprising the one or more OGs; and burning, at a flare section disposed on the exhaust stack, the exhaust gas and the process fluid comprising the one or more OGs, wherein the exhaust gas is a product of combustion in the internal combustion engine.

16. The method of claim 15, comprising:

controlling, via one or more controllers, combustion in the internal combustion engine to control a content of the exhaust gas at least partially based on burning at the flare section; and controlling, via one or more controllers, combustion in the flare section at least by controlling a ratio of the exhaust gas and the process fluid comprising the one or more OGs.

17. The method of claim 16, wherein controlling the ratio of the exhaust gas and the process fluid comprising the one or more OGs comprises controlling the ratio at least to control a flame temperature, emissions, or a combination thereof.

18. The method of claim 17, comprising sensing one or more operating parameters in the exhaust stack via one or more temperature sensors, one or more emissions sensors, or a combination thereof.

19. A combi-flare comprising:

an exhaust stack comprising a first inlet configured to receive an exhaust gas of an internal combustion engine and a second inlet configured to receive a process fluid comprising one or more speciated organic gases (OGs); and a flare section disposed vertically on top of the exhaust stack and comprising a pilot burner configured to ignite a mixture of the exhaust gas and the process fluid comprising the one or more OGs, wherein the exhaust gas is a product of combustion in the internal combustion engine.

20. The combi-flare of claim 19, comprising a controller configured to control a ratio of the exhaust gas and the process fluid comprising the one or more OGs at least to control a flame temperature, emissions, or a combination thereof, associated with combustion of the mixture.

21. The hydrocarbon processing site of claim 1, wherein the second portion of the process fluid comprises the one or more OGs and one or more additional substances desired to be disposed of via combustion, wherein the one or more OGs comprise Methane ($CH_4$), Ethane ($C_2H_6$), Propane ($C_3H_8$), Butane ($C_4H_{10}$), Pentane ($C_5H_{12}$), Hexane ($C_6H_{14}$), Heptane ($C_7H_{16}$), super heavies including hydrocarbons ($C_{8+}$), $H_2$, $H_2S$, $NH_3$, CO, $C_2H_2$, $C_2H_4$, $C_3H_6$, or any combination thereof, wherein the one or more additional substances comprise fugitive gases, total hydrocarbons (THC), volatile organic compounds (OG), non-methane hydrocarbons (NMHC), non-ethane hydrocarbons (NEHC), total organic gases (TOG), non-methane organic gases (NMOG), and/or hazardous air pollutants (HAPs), nitrogen ($N_2$), carbon dioxide ($CO_2$), helium (He), argon (Ar), halogens (e.g., Cl, Fl), or any combination thereof.

22. The hydrocarbon processing site of claim 1, comprising a controller configured to control a ratio of the exhaust gas and the process fluid comprising the one or more OGs at least to control a flame temperature, emissions, or a combination thereof, associated with combustion of the mixture.

* * * * *